US005363972A

United States Patent [19]

Gilmore

[11] Patent Number: 5,363,972

[45] Date of Patent: Nov. 15, 1994

[54] CONVEYOR APPARATUS WITH POWERED LEVELING ROLL

[76] Inventor: Larry J. Gilmore, 17555 SE. Braden Ct., Gladstone, Oreg. 97027

[21] Appl. No.: 836,794

[22] Filed: Feb. 14, 1992

[51] Int. Cl.[5] ..... B07C 7/04

[52] U.S. Cl. ..... 209/705; 209/930; 198/455

[58] Field of Search ..... 198/311, 455, 550.01, 198/550.3, 530, 534; 209/702, 705, 910, 930, 911

[56] References Cited

U.S. PATENT DOCUMENTS

| | | | |
|---|---|---|---|
| 329,954 | 11/1885 | Savage | 198/530 X |
| 1,220,801 | 3/1917 | Varga | 198/530 X |
| 1,235,281 | 7/1917 | Boera | 209/705 X |
| 1,416,763 | 5/1922 | Thom | 198/455 X |
| 1,422,600 | 7/1922 | Molins | 198/455 |
| 1,473,633 | 11/1923 | Lea | 198/534 |
| 1,582,820 | 4/1926 | Hungerford | 198/455 X |
| 2,661,090 | 12/1953 | Garrett | 209/910 X |
| 3,008,580 | 11/1961 | Lakso | 209/705 X |
| 3,590,983 | 7/1971 | Oury | 198/530 X |
| 3,680,719 | 8/1972 | Reilly | 198/550.01 X |
| 3,905,471 | 9/1975 | LaPeyre | 198/550.01 X |
| 4,014,460 | 3/1977 | Bryan, Jr. | 198/455 X |

FOREIGN PATENT DOCUMENTS

| | | | |
|---|---|---|---|
| 0964903 | 5/1957 | Germany | 198/534 |
| 2104704 | 1/1980 | Germany | 198/455 |
| 3644603 | 10/1987 | Germany | 209/705 |
| 0104162 | 1/1979 | Japan | 198/455 |
| 2206297 | 1/1989 | United Kingdom | 209/930 |

*Primary Examiner*—James R. Bidwell
*Attorney, Agent, or Firm*—Robert L. Harrington

[57] ABSTRACT

A sorting conveyor is shown and described for moving composite material through the output gate of a bin and then past a sorting station to remove unwanted elements of the composite material. At the interior side of the output gate rests a powered leveling roll rotatable about an axis transverse to the material flow for maintaining a selected volume of composite material exiting the bin. An upward and forward facing portion of the powered leveling roll is shielded against contact with the composite material in the bin. A downward and rearward facing portion of the powered leveling roll, including the portion opposing the conveyor, moves opposite the direction of material flow. The powered leveling roll includes formations for engaging the composite material and repelling excess material. The powered leveling roll thereby keeps the output gate from jamming, provides a metering function for controlling the amount of material flow released from the bin, and maintains a desirable cyclic flow of material within the bin to avoid bridging.

21 Claims, 3 Drawing Sheets

CONVEYOR APPARATUS WITH POWERED LEVELING ROLL

BACKGROUND OF THE INVENTION

This invention relates generally to apparatus for material movement and manipulation, and particularly to a conveyor apparatus for moving material from a bin.

The subject matter of the present invention may be applied to processes associated with recycling of certain materials. In recycling procedures, selected material for recycling must be separated from other undesirable material often included in the deposits provided by consumers. In paper recycling, for example, consumers often include baling wire, string, bags, and other undesirable material within the body of material deposited as recyclable newspaper. Before the newspaper can be recycled, however, this extraneous and undesirable material must be separated in order to avoid contamination of the recycled paper product and avoid the potential for damage to the paper making machinery.

It is then necessary in many recycling operations to separate composite material, e.g., separate recyclable newspaper material from undesirable material such as strings, wires and the like. Workers manually sort through a pile of the composite material to separate the undesirable material and recyclable material. The preferred embodiment of the present invention finds application in aiding manual separation of such composite material.

SUMMARY OF THE INVENTION

A preferred embodiment of the present invention in a first aspect is a conveyor arrangement for transporting composite material from a collection bin through an output gate of the bin. The conveyor arrangement according to a preferred embodiment of the present invention includes a conveyor belt defining a floor of the collection bin and moving in a forward direction from within the collection bin toward and through the output gate. The output gate is adapted to meter the volume of material exiting the bin onto a sorting station where workers manually separate the composite material by pulling undesirable material from the conveyor belt. The selected material then continues to a conveyor drop-off for delivery into an output bin. By metering output from the collection bin, production can match the ability of the workers for overall maximum efficiency.

In a second aspect of the present invention, metering of material output is provided by a powered leveling roll mounted within the bin and adjacent the output gate for rotation about an axis transverse to and in a direction opposite of the direction of the conveyor belt movement. Specifically, in the preferred embodiment, a downward facing portion of the leveling roll opposing the conveyor belt in face-to-face relation moves in a rearward direction, i.e., opposite the forward direction of the conveyor belt. The leveling roll thereby repels material moving toward the output gate and above the upper edge of the output gate. The leveling roll reduces jamming of the output gate and produces a desirable cyclic material flow within the collection bin as the leveling roll lifts the excess material up and away from the conveyor belt as it approaches the output gate.

According to another aspect of the present invention, a shielding arrangement prevents material contact with certain portions of the leveling roll to optimize use of the leveling roll. In the preferred embodiment, upward and a forward facing portions of the roll are protected against material contact and while downward and rearward facing portions of the roll are exposed.

In another aspect of the present invention, the leveling roll is vertically positionable for selected metering of material flow. In the preferred embodiment, the leveling roll and its drive motor are mounted integrally upon the shielding arrangement. The drive motor, leveling roll and shielding arrangement are vertically positioned relative to the conveyor belt for selected metering of material flow from the collection bin.

In accordance with the preferred embodiment of the present invention as applied to the processing of recyclable newspaper and other materials, the leveling roller includes material engaging formations specially adapted to engage the body of composite material within the collection bin without unduly shredding the material, but sufficiently engaging the material to provoke the desired material flow. In the preferred embodiment, the material engaging formations of the leveling roll are planar rib formations oriented in line with the material output flow and having an undulating peripheral contour sufficiently engaging the composite material, but not tearing or shredding the material in such engagement.

The subject matter of the present invention is particularly pointed out and distinctly claimed in the concluding portion of this specification. However, both the organization and method of operation of the invention, together with further advantages and objects thereof, may best be understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION OF THE PREFERRED EMBODIMENT

Figure 1:
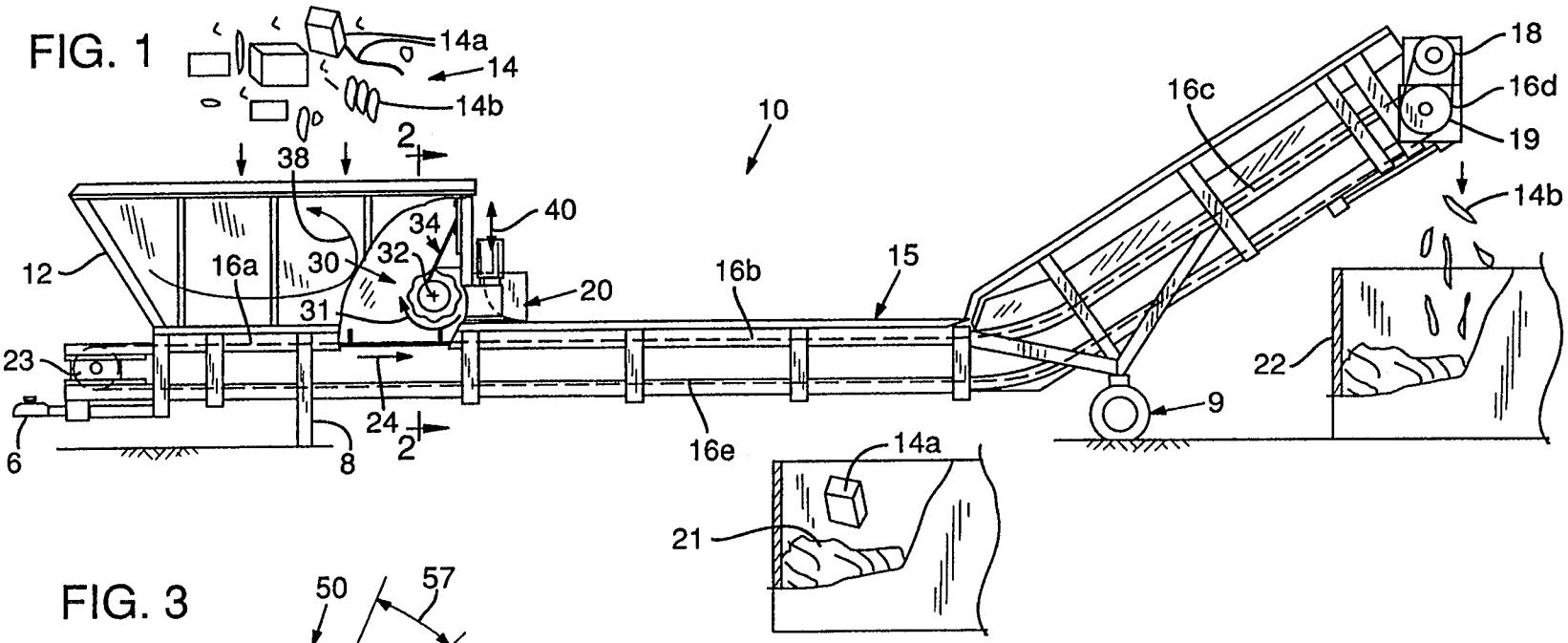
FIG. 1 is a side view partially cut away of a sorting conveyor employing a powered leveling roll within a collection bin according to a preferred embodiment of the present invention.

FIG. 1 is a side view of a sorting conveyor 10 for the separation of composite material 14. The illustrated embodiment of the present invention is adapted for use in recycling newspaper as composite material 14 as well as other recyclable or reusable material, and may therefore be applied to such other materials. Sorting conveyor 10 includes a collection bin 12 for receiving composite material 14 by dumping therein. The purpose of conveyor 10 is to aid in manual separation of undesirable elements 14*a*, such as string, baling wire, cardboard, sacks, or any other recyclable materials from selected material 14*b*, i.e., recyclable materials and newspaper materials. The composite material 14 is taken from bin 12 and transported through a sorting station 15 for manipulation by workers separating the undesirable elements 14*a* and allowing the selected material 14*b* to pass through.

The sorting conveyor 10 is a portable apparatus which may be advantageously moved to various locations in a processing plant. In support of such portability, conveyor 10 includes a hitch coupling 6, a ground contacting supporting frame 8 and a wheel assembly 9. The conveyor 10 thereby rests upon support frame 8 and wheel assembly 9, but may be moved by attachment at the hitch coupling 6 in order to raise the conveyor 10 off the ground at the support frame 8 and move the entire conveyor 10 as supported on wheel assembly 9. Because the conveyor 10 is conveniently portable, conveyor 10 may be moved to various processing areas where various composite material 14 may be located.

A conveyor belt 16 includes a first horizontal portion 16*a* defining the floor of bin 12, a second horizontal portion 16*b* defining the sorting station 15 and an inclined portion 16*c* extending upward from portion 16*b* to a dumping point 16*d* of conveyor belt 16. A return portion 16*e* of conveyor belt 16 couples dumping point 16*d* with the portion 16*a*. Conveyor belt 16 further includes cleats 17 (FIGS. 2 and 4) for engaging material 14. A conveyor motor 18 couples to a drive roller 19 to move conveyor belt 16 in a clockwise direction, as seen in FIG. 1, and transport composite material 14 from within bin 12 through an output gate 20 of bin 12 and on to the sorting station 15. A tensioning roller 23 slidably positionable upon the frame at conveyor 10 maintains suitable tension in conveyor belt 16. As composite material 14 exits bin 12 and moves along portion 16*b*, workers occupying the sorting station 15 remove undesirable elements 14*a* and discard them in side bins, e.g., bin 21. Selected material 14*b* then passes through the sorting station 15 and up portion 16*c* for discharge at the dumping point 16*d* into an output bin 22.

As conveyor 16 moves along a path beginning at the floor of bin 12 and passing through output gate 20, conveyor belt 16 provokes a material flow 24 out from bin 12 through output gate 20 and toward the sorting station 15. The direction of material flow 24 is, then, coincident with the movement of portions 16*a* and 16*b* of conveyor belt 16.

As used herein the terms "forward" or "front" and the terms "rearward" or "rear" shall be with reference to the direction of material flow 24. For example, conveyor belt portions 16*a* and 16*b* move in a forward direction. The terms "upward" and "downward" shall be with reference to the conveyor 10 as shown in the figures.

Figure 2:
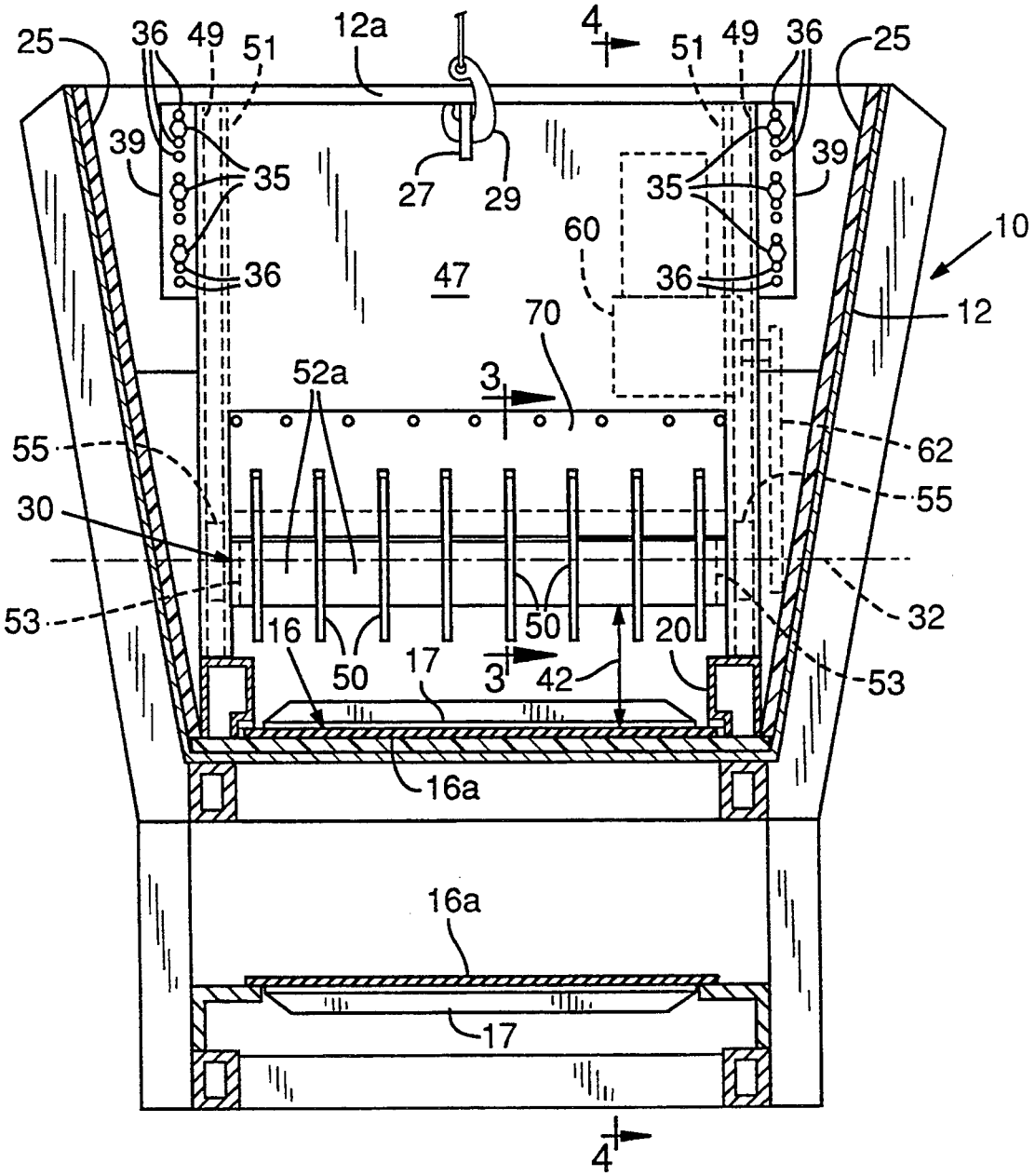
FIG. 2 is a sectional view taken along lines 2—2 of FIG. 1 showing the powered leveling roll from within the collection bin of the sorting conveyor.

A powered leveling roll 30 mounts within bin 12 adjacent to gate 20 and rotates in the direction 31 about an axis 32 transverse to material flow 24. FIG. 2 is a sectional view of the sorting conveyor 10 as taken along lines 2—2 of FIG. 1 showing the leveling roll 30 as seen from within bin 12. In FIGS. 1 and 2, shielding arrangement 34 protects upward and forward facing portions of leveling roll 30 while leaving exposed downward and rearward facing portions of roll 30. The rotational direction 31 for powered leveling roll 30 is such that the downward facing portion of roll 30, i.e., in face-to-face relation to conveyor belt 16, moves rearward, i.e., in a direction opposite that of material flow 24. Leveling roll 30 thereby repels some material 14 within bin 12 as it approaches output gate 20. Specifically, it repels material 14 above the height of the downward facing portion of leveling roll 30. Also, the rearward facing, upward moving portion of leveling roll 30 lifts material 14 up and away from conveyor belt 16. The shielding arrangement 34 prevents material 14 from contacting the remaining portions of leveling roll 30, i.e., the upward facing, forward moving, and the forward facing, downward moving portions of roll 30.

A cyclic material flow 38 within bin 12 results. More particularly, the forward moving portion 16*a* of conveyor belt 16 together with the rearward facing, upward moving portion of leveling roll 30 causes some of material 14 to first move forward in bin 12, then upward and backward. As a result, the portion of material 14 within bin 12 and below the downward facing portion of roll 30 exits output gate 20, but the remainder of material 14 within bin 12 moves along the cyclic material flow 38 within bin 12. It is suggested that bin 12 be provided with a plastic lining 25 to reduce frictional interaction with material 14. A suitable lining 25 for use in connection with recyclable materials and newspaper recycling is HDPE type plastic. Eventually, all material 14 within bin 12 exits bin 12 by way of output gate 20, but the rate at which material 14 exits bin 12 is a function of the vertical position of leveling roll 30 relative to conveyor belt 16. In other words, leveling roll 30 performs a metering function according to its vertical position.

The powered leveling roll 30 and shielding arrangement 34 are integrally joined for mounting to bin 12 at selected vertical positions relative to conveyor belt 16 as indicated by the double headed arrow 40 of FIG. 1. Thus, selected positioning of the shielding arrangement 34 and leveling roll 30 corresponds to a desired volume of material 14 exiting bin 12. For a sorting station 15 adapted to handle relatively larger volumes of material 14, i.e., either a greater number of workers or more efficient workers, the shielding arrangement 34 and leveling roll 30 are raised relative to conveyor belt 16 to release a corresponding greater volume of material 14 within material flow 24. Conversely, for a sorting station 15 having fewer workers sorting or less efficient workers sorting, the shielding arrangement 34 and leveling roll 30 may be lowered relative to conveyor belt 16 to reduce the volume of material 14 in material flow 24. Also, selected metering of material 14 from bin 12 may be needed due to the composition of material 14, e.g., if an unusually large volume of undesirable elements 14a are present a corresponding lesser volume of material 14 should be released from bin 12 to allow for increased processing time needed.

In FIG. 2, the shielding arrangement 34 and leveling roll 30 are vertically positionable by means of mounting apertures 36 in shielding arrangement 34 and corresponding vertically aligned stud 35 mounting apertures 37 in the forward panel 12*a* of bin 12. More particularly, shielding arrangement 34 includes outward extending mounting plates 39 which carry the mounting apertures 36 and lie in face to face relation with the inner surface of the forward panel 12*a* of bin 12. The studs 35 extend through apertures 37 in panel 12*a* to engage selected ones of apertures 36 for selected vertical positioning of shielding arrangement 34 relative to conveyor belt 16.

The output gate 20 then has a height 42 corresponding to the vertical position of leveling roll 30 as mounted upon shielding arrangement 34. Vertical positioning of leveling roll 30 and shielding arrangement 34 is accomplished by a crane hook 29 and hook receiving formation 27 of arrangement 34.

Figure 3:
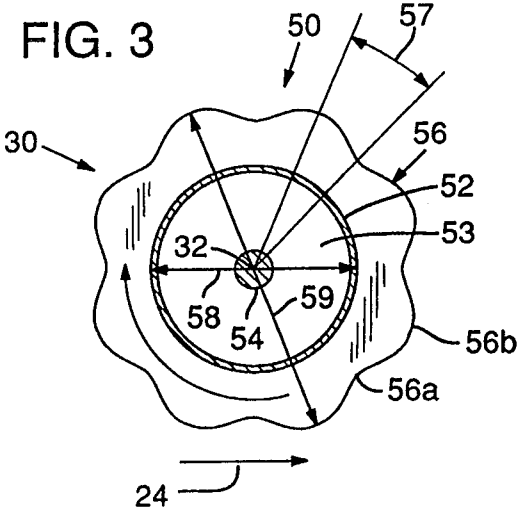
FIG. 3 is a sectional view taken along lines 3—3 of FIG.2 showing the structure of the powered leveling roll and the profile of material engaging formations thereof.

Powered leveling roll 30 includes as material 14 engaging members a series of planar rib formations 50 distributed along its length. FIG. 3 is a sectional view of the leveling roll 30 as taken along lines 3—3 of FIG. 2 and illustrating the profile of a rib formation 50. In FIGS. 2 and 3, the leveling roll 30 includes a cylinder 52 supported at end plates 53 by a central shaft 54. The rib formations 50 mount upon the exterior surface of cylinder 52. Leveling roll 30 is constructed by welding end plates 53 to cylinder 52, and welding central shaft 54 to end plates 53. The ends of shaft 54 are supported by bearings 55 of shielding arrangement 34. Bearings 55 rest between outer side plates 49 and inner side plates 51 of shielding arrangement 34. More particularly, an outer side plate 49 and inner side plate 51 lie in face to face relation on each side, i.e., right and left side in the view of FIG. 2, of shielding arrangement 34 and provide structural integrity for the shielding arrangement 34. A face plate 47 of shielding arrangement 34 lies across the rearward facing edges of plates 49 and 51 as the upward facing, material 14 engaging shielding portion of shielding arrangement 34. Rib formations 50 also weld upon the exterior surface of cylinder 52. By such construction, the integrated shielding arrangement 34 and leveling roll 30 represent a durable component well adapted for operation against the weight of a large volume of composite material 14 within bin 12.

In FIG. 3, rib formations 50 are generally planar formations having an orientation aligned with the material flow 24, but specially adapted for the engagement of composite material 14. In the case of newspaper as composite material 14, each rib formation 50 defines an undulating peripheral edge 56 of alternating concave portions 56*a* and convex portions 56*b*. The radius of curvature for each concave portion 56*a* and for each convex portion 56*b* is $2\frac{1}{2}$ inches. The peek to peek angle of separation 57 for convex portions 56*b* is typically 45 degrees. The outer diameter measurement 58 for cylinder 52 is $10\frac{7}{8}$ inches. The outer diameter measurement 59 for leveling roll 30, i.e., peek to peek measure for opposing convex portions 56, is $13\frac{3}{4}$ inches. The rib elements 50 may be formed from $\frac{3}{8}$ inch metal stock. In the illustrated embodiment, eight such rib formations 50 are distributed along the length of leveling roll 30. It is suggested that the rib elements 50 be angularly offset relative to one another, e.g., by $\frac{1}{2}$ the angle 57, to enhance the material engaging character of roll 30. Overall, the undulating peripheral edges 56 suitably engage the composite material 14 to produce the desired material flows 24 and 38, but without significantly tearing or shredding composite material 14.

Figure 4:
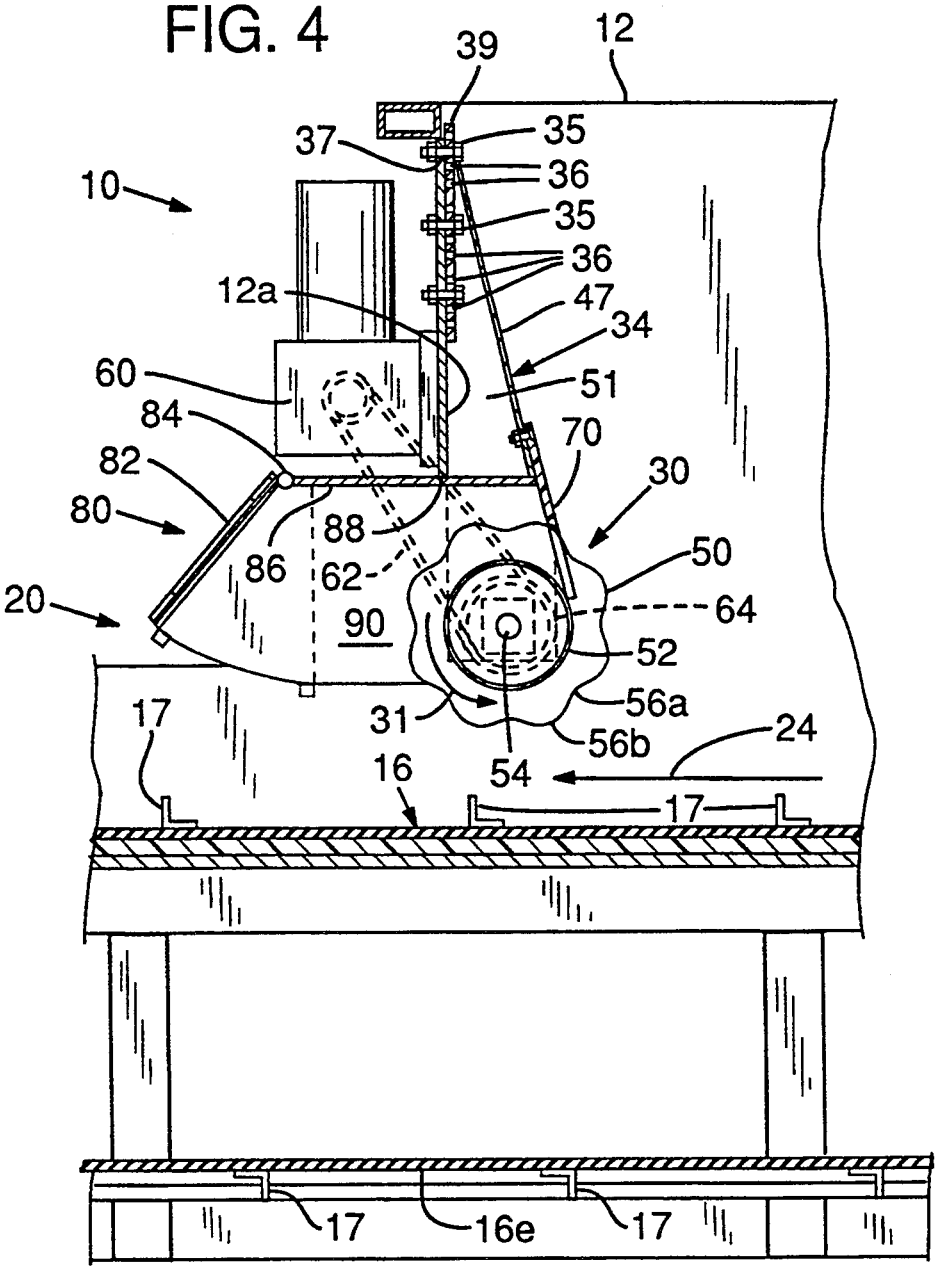
FIG. 4 is a sectional view taken along lines 4—4 of FIG. 2 showing a drive arrangement for rotating the powered leveling roll and a mounting arrangement for the powered leveling roll and drive arrangement providing selected vertical positioning of the powered leveling roll.

FIG. 4 is a sectional view taken along lines 4—4 of FIG. 2 and illustrating a drive mechanism for the leveling roll 30. In FIG. 4, a rotor drive reduction motor 60 couples by drive chain 62 to a sprocket 64 mounted fixedly to central shaft 54 of leveling roll 30. Motor 60 rotates in the direction 31, counter-clockwise in the view of FIG. 4, for similar rotation of the leveling roll 30 in the direction 31. A rib guard 70 (see also FIG. 2) extends from shield arrangement 34 to near the exposed portion 52*a* of cylinder 52, i.e., between rib formations 50, and near the exposed surfaces of rib formations 50. In this manner, the shielding arrangement 34 together with the rib guard 70 shields upward and forward facing portions of leveling roll 30 while leaving exposed downward and rearward facing portions of leveling roll 30.

Shielding arrangement 34 further includes at the rearward facing side of leveling roll 30 an access tunnel 80. Access tunnel 80 includes access door 82 pivotable about a horizontal transverse hinge 84 for providing access to the rearward side of leveling roll 30. More particularly, a bottom plate 86 of shielding arrangement 34 extends from within bin 12 and past the lower edge 88 of front panel 12*a* and beyond some distance to the hinge 84. Tunnel side panels 90 of access tunnel 80 further define a generally rectangular access area on the rearward side of leveling roll 30. It may be appreciated that the access tunnel 80, being integrally formed with the shielding arrangement 34, leveling roll 30, and drive motor 60 moves vertically therewith.

In operation, composite material 14 may be dumped into bin 12 while conveyor belt 16 and leveling roll 30 operate in the indicated directions. In the illustrated embodiment, a typical belt 16 travel speed is 30–40 feet/minute. For the leveling roll 30, a lineal speed of two to three hundred feet/minute is suitable. The speed may vary, however, depending on the type of material processed. The material flow 24 then emerges from bin 12 for processing at the sorting station 15 while the leveling roll 30 prevents jamming at the output gate 20. The presence of leveling roll 30 at the output gate 20, in maintaining the cyclic flow 38, also prevents undesirable bridging of the body of composite material 14 within bin 12 and thereby further contributes to a more efficient overall flow of material 14 through the sorting conveyor 10.

It will be appreciated that the present invention is not restricted to the particular embodiment that has been described and illustrated, and that variations may be made therein without departing from the scope of the invention as found in the appended claims and equivalents thereof. For example, while the present invention has been illustrated and described in the context of newspaper recycling, it will be understood that other materials may be processed by the conveyor 10 according to the present invention and should be considered as within the scope of the present invention.

What is claimed is:

1. A composite material processing conveyor arrangement comprising:

a body of composite material of given condition comprising components of different size and shape and composition;

a collection bin having an output gate, the bin receiving and holding said body of composite material therein;

a conveyor belt defining a floor of the collection bin and moving in a forward direction from within the collection bin, toward the output gate, through the output gate, defining a manual hand picking station exterior of the bin, and continuing to a dumping point whereby said body of composite material may be deposited in the bin and passed through the manual hand picking station whereat undesirable elements may be manually separated from desirable elements, one of said undesirable elements and said desirable elements continuing to the dumping point for deposit in an output bin; and metering apparatus at said output gate for controlling a flow of the body of composite material through said gate in response to said belt forward movement, said metering apparatus being non-destructive and substantially maintaining said given condition of said composite material in said flow.

2. A conveyor arrangement according to claim 1 wherein said metering apparatus comprises a powered leveling roll within the bin, adjacent the output gate, and rotating about an axis transverse to the forward direction in such rotational direction that a downward facing portion of the roll opposing in face-to-face relation the conveyor belt moves in a rearward direction opposite the forward direction.

3. A conveyor arrangement according to claim 2 further comprising shielding means protecting portions of the powered leveling roll against contact with the material.

4. A conveyor arrangement according to claim 3 wherein the shielding means protects an upward and a forward facing portion of the roll and leaves exposed a downward and rearward facing portion of the roll.

5. A conveyor arrangement according to claim 4 wherein the shielding means is adapted for allowing the powered leveling roll to repel and lift upward material in a material flow toward the output gate which is above a given height relative to the conveyor.

6. A conveyor arrangement according to claim 2 wherein the powered leveling roll includes material engaging formations adapted for suitably engaging the material without significantly tearing the material.

7. A conveyor arrangement according to claim 6 wherein said material engaging formations comprise rib formations.

8. A conveyor arrangement according to claim 7 wherein the rib formations are planar and oriented in line with the material output flow.

9. A conveyor arrangement according to claim 2 further comprising mounting means for the leveling roll permitting vertical positioning relative to the conveyor belt.

10. In a conveyor apparatus removing for manual hand sorting composite material comprising elements of different size and shape and composition from within a collection bin out through an output gate of the bin by way of a conveyor belt defining the floor of the bin and moving from within the bin forward toward the output gate, a flow control arrangement comprising:

a body of composite material of given condition comprising components of different size and shape and composition;

a powered leveling roll mounted within the bin adjacent the output gate and adapted for rotation wherein a downward facing surface portion of the roll in face-to-face relation to the conveyor moves rotationally away from the output gate to non-destructively engage a flow of the body of composite material while maintaining said given condition moving forward within the bin toward the output gate in such manner to allow a first portion of said flow to emerge from the output gate and to lift upward within said bin a second portion of said flow to create in combination with said conveyor belt a cyclic flow of composite material resting upon said conveyor belt and against said roll within said bin, a lower portion of said cyclic flow following forward movement of said conveyor belt, a forward portion following upward movement of said roll, an upper portion moving rearward, and a rearward portion moving downward to rejoin said lower portion; and a manual sorting station receiving said first portion of said composite material following exit from said bin whereat said first portion may be manually sorted for recovery of selected elements.

11. A flow control arrangement according to claim 10 further comprising shielding protecting upward and forward facing portions of said roll against material contact.

12. A flow control arrangement according to claim 10 further comprising leveling roll mounting to define both gate height and position of the leveling roll relative to the conveyor belt.

13. A flow control arrangement according to claim 10 wherein the roll includes material engaging formations for engaging and repelling material above a given height relative to the conveyor, the given height corresponding to the height of the output gate relative to the conveyor belt.

14. A flow control arrangement according to claim 13 wherein the material engaging formations comprise rib formations.

15. A flow control arrangement according to claim 14 wherein said rib formations are planar and oriented in-line with the material output flow.

16. A sorting conveyor for the separation of composite material, the sorting conveyor comprising:

a collection bin for receiving the composite material, the collection bin having an output gate;

a conveyor belt including a substantially horizontal sorting portion suitable for manual separation of composite material thereon, an inclined portion for moving composite material to an overhead dumping point of the conveyor, and a collection portion forming at least a portion of a floor of the collection bin;

a conveyor motor for moving the conveyor belt along a path beginning at the floor portion, passing through the output gate of the collection bin, passing along the sorting portion, passing along the inclined portion, passing through the dumping point and returning to the collection portion whereby placement of composite material on the bin floor and actuation of the conveyor motor produces a material output flow from the collection bin, through the output gate of the collection bin, and along the sorting portion whereat separation may occur leaving a selected element of the composite material on the conveyor which then moves along the inclined portion for exiting the sorting conveyor at the dumping point of the conveyor; and metering apparatus at the output gate for selectively metering a volume of material exiting the bin through the output gate.

17. A sorting conveyor according to claim 16 wherein said metering apparatus comprises:

a powered leveling roll within the bin adjacent the output gate and rotatable about an axis transverse to the material output flow for maintaining a level of composite material exiting the bin corresponding to the separation between an upper edge of the of the output gate and the conveyor belt;

shielding within the bin for protecting upward and forward facing portions of the powered leveling roll from contact with composite material within the bin, downward and rearward facing portions of the powered leveling roll being exposed for contacting the composite material, the downward facing portion opposing the conveyor in face-to-face relation;

a roll motor for rotating the powered leveling roll in such direction that the downward facing portion moves opposite the movement of the portion of the conveyor it opposes for repelling material above a level corresponding to the output gate level whereby the leveling roll reduces jamming of the output gate, provides a metering function determining the volume of composite within the material output flow, and produces a cycling material flow within the bin having a lower path along the material output flow and an upper path opposite thereto; and a mounting arrangement for the powered leveling roll, shielding, and roll motor vertically positionable relative to the conveyor belt to provide a selected volume of composite material within the material flow.

18. A material processing conveyor arrangement comprising:

a collection bin having an output gate and adapted for dumping of material therein;

a conveyor belt defining a floor of the collection bin and moving in a forward direction from within the collection bin, toward the output gate, through the output gate, defining a picking station exterior of the bin, and continuing to a dumping point whereby composite material may be deposited in the bin and passed through the picking station whereat undesirable elements may be removed and desirable elements may continue to the dumping point for deposit in an output bin; and metering apparatus at said output gate for controlling a flow of the material through said gate in response to said belt forward movement, the metering apparatus including a powered leveling roll within the bin, adjacent the output gate, and rotating about an axis transverse to the forward direction in such rotational direction that a downward facing portion of the roll opposing in face-to-face relation the conveyor belt moves in a rearward direction opposite the forward direction, the powered leveling roll including material engaging formations comprising rib formations adapted for suitably engaging the material without significantly tearing the material, at least one rib formation including an undulating peripheral contour.

19. A material processing conveyor arrangement comprising:

a collection bin having an output gate and adapted for dumping of material therein;

a conveyor belt defining a floor of the collection bin and moving in a forward direction from within the collection bin, toward the output gate, through the output gate, defining a picking station exterior of the bin, and continuing to a dumping point whereby composite material may be deposited in the bin and passed through the picking station whereat undesirable elements may be removed and desirable elements may continue to the dumping point for deposit in an output bin; and metering apparatus at said output gate for controlling a flow of the material through said gate in response to said belt forward movement, the metering apparatus including a powered leveling roll within the bin, adjacent the output gate, and rotating about an axis transverse to the forward direction in such rotational direction that a downward facing portion of the roll opposing in face-to-face relation the conveyor belt moves in a rearward direction opposite the forward direction, the powered leveling roll including material engaging formations comprising rib formations adapted for suitably engaging the material without significantly tearing the material, the rib formations each being planar, oriented in line with the material output flow, and having an undulating peripheral contour.

20. In a conveyor apparatus removing material from within a collection bin out through an output gate of the bin by way of a conveyor belt defining the floor of the bin and moving from within the bin toward the output gate, a flow control arrangement comprising:

a powered leveling roll mounted within the bin adjacent the output gate and adapted for rotation wherein a downward facing portion of the roll in face-to-face relation to the conveyor moves away from the output gate, the roll including material engaging rib formations for engaging and repelling material above a given height relative to the conveyor, the given height corresponding to the height of the output gate relative to the conveyor belt, at least one rib formation including an undulating peripheral contour.

21. In a conveyor apparatus removing material from within a collection bin out through an output gate of the bin by way of a conveyor belt defining the floor of the bin and moving from within the bin toward the output gate, a flow control arrangement comprising:

a powered leveling roll mounted within the bin adjacent the output gate and adapted for rotation wherein a downward facing portion of the roll in face-to-face relation to the conveyor moves away from the output gate, the roll including material engaging rib formations for engaging and repelling material above a given height relative to the conveyor, the given height corresponding to the height of the output gate relative to the conveyor belt, the material engaging rib formations being planar and oriented in-line with the material output flow and each rib formation including an undulating peripheral contour.

* * * * *